United States Patent [19]

Braun et al.

[11] Patent Number: 4,715,658

[45] Date of Patent: Dec. 29, 1987

[54] PLANING MACHINE FOR THE MINING OF MINERALS

[75] Inventors: Gert Braun; Ernst Braun, both of Essen-Heisingen, Fed. Rep. of Germany

[73] Assignee: Halbach & Braun Industrieanlagen, Fed. Rep. of Germany

[21] Appl. No.: 20,131

[22] Filed: Feb. 26, 1987

Related U.S. Application Data

[63] Continuation of Ser. No. 778,556, Sep. 20, 1985, abandoned.

[30] Foreign Application Priority Data

Sep. 20, 1984 [DE] Fed. Rep. of Germany ..... 3434518

[51] Int. Cl.[4] ..... E21C 25/42

[52] U.S. Cl. ..... 299/34

[58] Field of Search ..... 299/32, 34, 42, 43

[56] References Cited

U.S. PATENT DOCUMENTS 2,795,407 6/1957 Bobersen ..... 299/34
3,388,948 6/1968 Lobbe et al. ..... 299/34
4,453,771 6/1984 Merten et al. ..... 299/34

FOREIGN PATENT DOCUMENTS 270190 10/1961 Netherlands ..... 299/34
238483 3/1969 U.S.S.R. ..... 299/34

*Primary Examiner*—Stephen J. Novosad
*Assistant Examiner*—John F. Letchford
*Attorney, Agent, or Firm*—McGlew and Tuttle

[57] ABSTRACT

A planing machine for the mining of minerals particularly a coal plane which has a planing chain guided on the filling side, and comprises two individual planes with plane bodies interconnected by an articulated connection, a sword plate of each plane body grips under a conveyor chute. The plane bodies are each supported on each plane against a conveyor chute sidewall on the coal face side by means of a horizontal, centrally mounted roller. Vertical bearing pins of the rollers form floating shafts for the plane bodies. Sword plates are individually connected to the planing chain and are not interconnected by otherwise used hinges. This makes for a good ability to negotiate curves and adaptability when traversing curves as well as troughs and saddles.

4 Claims, 3 Drawing Figures

1
2a
2b
3
4a
4b
5a
5b
7
8
9
11
12
13
14
15
16
17

PLANING MACHINE FOR THE MINING OF MINERALS

This application is a continuation of application Ser. No. 778,556, filed Sept. 20, 1985, now abandoned.

FIELD AND BACKGROUND OF THE INVENTION

This invention relates in general to planing machines and in particular to a new useful machine for the underground mining of coal.

The invention relates to a planing machine for the mining of minerals, in particular to a coal plane for underground mining with a planing chain guided on the filling side, and comprising at least two individual planes with plane bodies joined to each other via an articulated connection and with a sword plate of each plane body gripping under a conveyor chute.

In such planing machines, the sword plates are usually interconnected by hinges with hinge pins extending perpendicular to the planing direction. This is to obtain the necessary adaptability to the floor when traversing troughs or saddles. But the articulated connections necessitates a relatively long link plate and, consequently, a relatively long lever arm which is to serve for the absorption of the considerable transverse forces occurring when the planing machine is working, namely when the planing knives of the planes engage the face to be mined. The occurring transverse forces are even increased yet by the fact that they are guided by gliding friction along the conveyor chute sidewall on the face side. All this requires the use of relatively big sword plates whose adaptability to the floor, even considering the hinge connections, is often unsatisfactory. This applies in particular to the inability to traverse curves.

SUMMARY OF THE INVENTION

The invention provides a planing machine, and in particular a coal plane whose individual planes or sword plates are characterized by their better ability to negotiate curves and their adaptability to the floor when traversing troughs and saddles, while keeping the design simple and functional.

According to the invention, the plane bodies are each supported by a horizontal, centrally mounted roller against the chute sidewall on the face side and the vertical bearing pins of the rollers form floating shafts for the plane bodies. In addition, the sword plates are individually connected to the planing chain and are not connected to each other by hinges or the like. The consequence of these inventive measures is, first of all, that the moments affecting the two individual planes in the area of the articulated connection between the two individual planes essentially cancel each other out. In addition, the transverse forces are mastered perfectly because the resultant force components are concentrated in the rollers. To this extent, success is achieved in absorbing the transverse forces in a rolling fashion; and due to the rolling friction between the individual planes or their plane bodies and the inside chute wall on the face side, the transverse forces are considerably further in comparision with the otherwise gliding friction. Due to the transverse forces resulting from the cutting forces of the working planing machine having been compensated to a great extent, it is possible to provide very much smaller, and in particular shorter, sword plates for the individual planes than heretofore.

In addition, since these shorter sword plates are connected only to the planing chain on the filling side while not being interconnected by joints or hinges, these sword plates can follow the unevennesses of the floor much better than the known ones. Therefore, better adaptability to the floor is achieved when traversing troughs and saddles. The same applies to negotiating curves. For, while the articulated connection between the two individual planes provies by itself sufficient horizontal freedom of motion to negotiate curves, and of course also sufficient vertical freedom of motion to traverse troughs and saddles, the ability to negotiate curves is achieved with respect to the sword plates by omitting the otherwise usual hinge connections.

The invention provides further that the one individual plane has planing knives working in the lower face area and the other individual plane has planing knives working in the upper face area to be mined. This construction makes for essentially identical torques acting upon the individual planes or their sword plates, cancelling each other out between the two sword plates. This further supports the effect already indicated above. Mounted on the plane bodies, in a usual manner, are tool holders which can be swung about vertical pivot pins to approach the face to be mined. The invention provides for the tool holders to have recesses for the partial accommodation of the rollers so as to assure their protected and contamination free accommodation.

The advantages obtained by the invention are seen in particular in that a planing machine, and in particular a coal plane is provided which, due to the torque and transverse forces resulting from the cutting forces being compensated to a great extent, can be, with relatively small and especially short sword plates for the individual planes, so that adaptability to the floor when traversing troughs and saddles, the also the ability to negotiate curves, is considerably improved. This succeeds by relatively simple and functional means, each plane or each sword plate being pulled individually by the planing chain.

Accordingly, it is an object of the invention to provide a planing machine for the mining of minerals particularly the underground mining of coal which uses a planing chain guided on the filling side of a conveyor chute which also has an opposite side wall, and which comprises at least two individual planes with an articulated connection joining the planes together and includes a plane body mounted on each plane for pivotal movement about its substantially vertical axis and with a sword plate associated with each plane body and having a portion extending under the chute and including a horizontal roller centrally carried on a plane which rotatably supports each respective plane body against the conveyor chute side wall, the rollers having bearing pins forming floating shafts for the plane bodies wherein the sword plates are individually connected to the planing chain and are not connected to each other.

A further object of the invention is to provide a planing machine for mining of minerals wherein the planes are connected by an articulated joint which includes a pin riding in a slot defined on one of the planes between a forked end of the other plane and which permits horizontal as well as some vertical shifting between the two planes.

A further object of the invention is to provide a planing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 2:
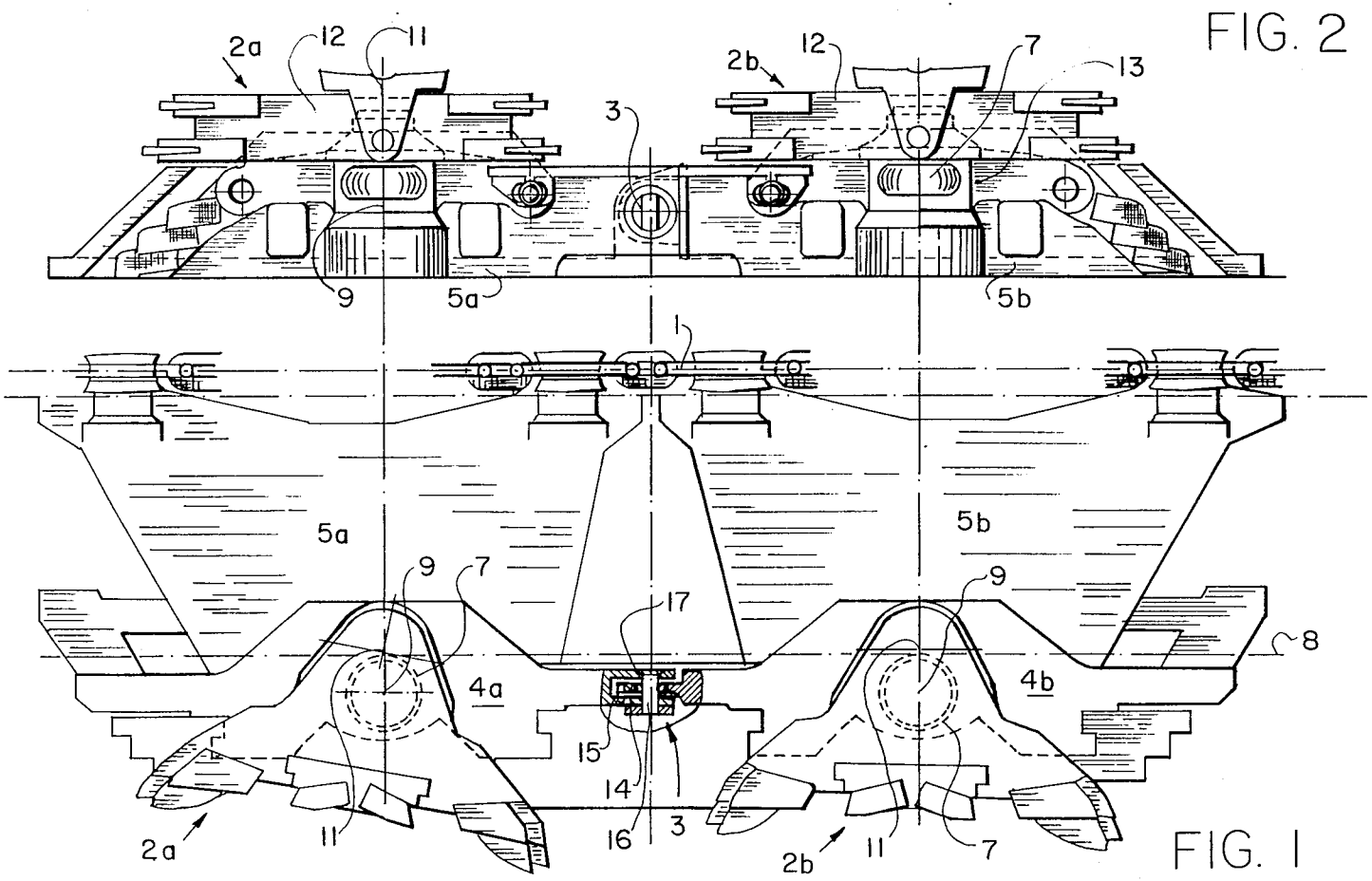
FIG. 1 is a diagrammatic top plan view of a planing machine according to the invention without a conveying chute.
FIG. 2 is a front view of the machine shown in FIG. 1.

Referring to the drawings in particular, the invention embodied therein comprises a planing machine for the mining of minerals particularly the underground mining of coal using a planing chain 1 which is guided on the filling side of a conveyor chute 6 which has a side wall 8 on a side opposite to the filling side and which comprises at least two individual planes or plane supports 2*a* and 2*b*. An articulated connecting joint generally designated 3 joins the planes 2*a*, 2*b* together. Each plane has a plane body 4*a* and 4*b* respectively carrying a tool holder 12 mounted on each plane body for pivotal movement about a substantially vertical axis 11. The ends of the plane body define or hold a knife or cutter. A sword plate 5*a* and 5*b* is associated with each plane body and has a portion extending under the chute 6. In accordance with a feature of the invention, a horizontal roller 7 is centrally carried on each plane 2*a* and 2*b*. The roller 7 is in a recess of the plane and rotatably supports each respective plane body 4*a* and 4*b* against the conveyor chute side wall 8. The rollers 7 have bearing pins 9 forming floating shafts for the plane bodies. The sword plates 5*a* and 5*b* are individually connected to the planing chain 1 and are not connected to each other. The bearing pins 9 which rotatably support the rollers 7 in their respective plane 2*a* and 2*b*, are floating shafts in the sense that they are not connected to the chute 6. With the rollers 7 rolling against the side wall 8 of the chute 6, each of the plane bodies 4*a* and 4*b* roll against the side wall 8 and may pivot somewhat about the vertical axis in its bearing pin 9. The articulated connecting joint 3 between the plane bodies 4*a* and 4*b* permit a relative pivoting between the plane bodies.

In the figures, a planing machine for the mining of minerals, in particular a coal plane for underground mining is shown, the planing chain 1 being guided on the filling side. In its basic design, this coal plane comprises of at least two individual planes 2*a*, 2*b* with plane bodies 4*a*, 4*b* interconnected by the articulated connection 3.

Figure 3:
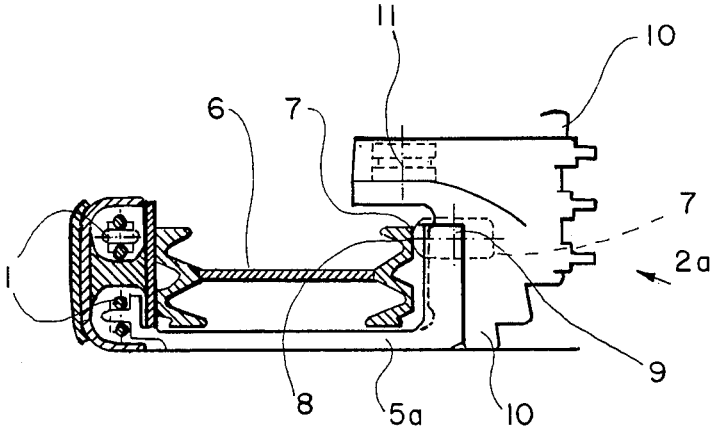
FIG. 3 is a partial transverse section of the planing machine of FIG. 1 with conveyor chute shown.

As shown in FIG. 3 a sword plate 5*a*, 5*b* of each plane body 4*a*, 4*b* grips under a conveyor chute 6. The plane bodies 4*a*, 4*b* are each supported against the chute side wall 8 on the coal face side by a horizontal, centrally mounted roller 7. The vertical bearing pins 9 of the rollers 7 form pivots or floating shafts for the plane bodies 4*a*,4*b*.

The sword plates 5*a* and 5*b* are each connected individually to the planing chain 1 and are not connected to each other, i.e. not interconnected by hinges or the like so that they can swing in both horizontal and vertical planes. The one individual plane 2*a* has planing knives 10 working in the lower face area, the other individual plane 2*b* has planing knives 10 working in the upper face area to be mined. Mounted on the plane bodies 4*a* and 4*b* in the usual manner are tool holders 12 which can be swung about vertical pivot pins 11 to approach the face to be mined. The tool holders 12 have recesses 13 for the partial accommodation of the rollers 7.

The articulated connection 3 between the two individual planes 2*a*, 2*b* consists of a fork 14, engaged by a connecting plate 15 with a pintle 16 running transverse to the planing direction for the vertical upswing. In addition, the connecting plate 15 engages the fork 14 with specified horizontal freedom of motion in planing direction as well as transverse thereto. To accomplish this, the connecting plate 15 encloses the hinge pin 16 with an oblong hole or slot 17 extending in a planing direction and which is spherical transverse to the planing direction. Overall, this creates a coal plane whose individual planes 2*a* and 2*b* are not only able to negotiate curves very well in the course of horizontal formations, but are also extremely adaptable to the molds and saddles of the floor in the course of vertical angular formations, especially since relatively short sword plates can be used due to the fact that the torque and transverse forces are compensated to a great extent.

While a specific embodiment of the invention has been shown and described in detail to illustrate the application of the principles of the invention, it will be understood that the invention may be embodied otherwise without departing from such principles.

What is claimed is:

1. A planing machine for the mining of minerals, particularly the underground mining of coal using a planing chain guided on the filling side of a conveyor chute having a side wall on a side opposite to the filling side, comprising two individual planes (2*a*, 2*b*) lying side-by-side along the conveyor chain, an articulated connection interconnecting said planes and permit relative pivoting between said planes in vertical and horizontal directions, each plane comprising a plane body (4*a*, 4*b*) and a sword plate (5*a*, 5*b*) connected to said plane body and having a portion extending under the conveyor chute and connected to the planing chain, a horizontally extending roller centrally carried by each of said planes, each horizontal roller being mounted for rotation about a vertical axis to one of said plane bodies, each roller being at least partly exposed for rolling against the side wall of the chute for permitting movement of each plane body along the side wall of the chute while also permitting rotation of each plane body about the vertical axis of its horizontal roller, said sword plates of said planes being individually connected to the planing chain and being unconnected from each other from one plane to the other for permitting horizontal and vertical pivoting between said planes only through said articulated connection.

2. A planing machine according to claim 1, including a tool holder pivotally mounted about a vertical axis to each plane body and carrying cutting tools.

3. A planing machine according to claim 1, wherein each plane body includes a recess, the horizontal roller of each plane body being rotatably mounted in the recess of its plane body.

4. A planing machine according to claim 3, including a tool holder pivotally mounted about a vertical axis to each plane body and carrying cutting tools.

* * * * *